US009291378B2

(12) United States Patent
Ueda et al.

(10) Patent No.: US 9,291,378 B2
(45) Date of Patent: Mar. 22, 2016

(54) SIMPLIFIED REFRIGERATION LEAK DETECTION STRUCTURE FOR A TURBO CHILLER

(71) Applicant: MITSUBISHI HEAVY INDUSTRIES, LTD., Tokyo (JP)

(72) Inventors: Kenji Ueda, Tokyo (JP); Yasushi Hasegawa, Tokyo (JP); Noriyuki Matsukura, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 484 days.

(21) Appl. No.: 13/669,601

(22) Filed: Nov. 6, 2012

(65) Prior Publication Data

US 2013/0133359 A1 May 30, 2013

(30) Foreign Application Priority Data

Nov. 30, 2011 (JP) ..... 2011-262437

(51) Int. Cl.

| | |
|---|---|
| ***F25B 43/00*** | (2006.01) |
| ***F25B 43/02*** | (2006.01) |
| ***F25D 19/00*** | (2006.01) |
| ***F25B 31/00*** | (2006.01) |
| ***F25B 49/00*** | (2006.01) |

(52) U.S. Cl.

CPC ..... *F25B 31/004* (2013.01); *F25B 49/005* (2013.01); *F25B 2500/222* (2013.01)

(58) Field of Classification Search

CPC ..... F25B 2500/22; F25B 500/222; F24F 2011/0054; F24F 2011/0084; F24F 13/222

USPC ..... 62/474, 298, 299, 468, 84

See application file for complete search history.

(56) References Cited

U.S. PATENT DOCUMENTS

| | | | | |
|---|---|---|---|---|
| 4,404,812 | A | 9/1983 | Zinsmeyer | |
| 6,170,286 | B1 * | 1/2001 | Keuper | 62/471 |

(Continued)

FOREIGN PATENT DOCUMENTS

| | | | |
|---|---|---|---|
| GB | 2428896 | A * | 2/2007 |
| JP | 50-158253 | U | 12/1975 |
| JP | 1-305266 | A | 12/1989 |

(Continued)

OTHER PUBLICATIONS

Notification of Reasons for Refusal dated Aug. 25, 2015, issued in counterpart Japanese Patent Application No. 2011-262437, w/English translation (11 pages).

*Primary Examiner* — Allen Flanigan
*Assistant Examiner* — Filip Zec
(74) *Attorney, Agent, or Firm* — Westerman, Hattori, Daniels & Adrian, LLP

(57) ABSTRACT

In a turbo chiller, pipe joint groups (23 to 26) provided to refrigerant cooling pipe systems (13 to 16) and lubricant pipe systems connected to a turbo compressor (2) and a motor (3), as well as a joint group (28) of various replacement components (27) provided to the pipe systems, are intensively placed, and at least one refrigerant detection sensor (32) is arranged below the intensive placement region (30) of the joint groups (23 to 28) and at a pre-identified point at which a slight amount of refrigerant that leaks from each of the joint groups (23 to 28) and flows downward is distributed and pools at a high concentration, whereby the slight amount of refrigerant leakage can be detected by the refrigerant detection sensor (32).

12 Claims, 5 Drawing Sheets

(56) References Cited

U.S. PATENT DOCUMENTS

| | | | | |
|---|---|---|---|---|
| 2008/0314068 | A1* | 12/2008 | Jang et al. | 62/474 |
| 2011/0000243 | A1* | 1/2011 | Jabbour et al. | 62/296 |

FOREIGN PATENT DOCUMENTS

| | | | |
|---|---|---|---|
| JP | 07-159010 | A | 6/1995 |
| JP | 2000-146393 | A | 5/2000 |
| JP | 2002-098346 | A | 4/2002 |
| JP | 2002-322999 | A | 11/2002 |
| JP | 2007-127388 | A | 5/2007 |
| JP | 2008-292066 | A | 12/2008 |
| JP | 2009-93467 | A | 4/2009 |
| JP | 2009-103364 | A | 5/2009 |
| JP | 2009-198154 | A | 9/2009 |
| JP | 2010-133601 | A | 6/2010 |
| JP | 2010-230181 | A | 10/2010 |
| WO | 2010/104057 | A1 | 9/2010 |

* cited by examiner

SIMPLIFIED REFRIGERATION LEAK DETECTION STRUCTURE FOR A TURBO CHILLER

TECHNICAL FIELD

The present invention relates to a turbo chiller including a turbo heat pump.

BACKGROUND ART

A turbo chiller including a turbo heat pump can store a larger amount of refrigerant than other chillers and heat pumps, and a turbo chiller having, for example, a capacity at the level of 500 refrigeration ton can store about 700 to 800 kg of refrigerant. Refrigerants used for turbo chillers at present are HFC134a, HFC245fa, and the like that are considered not to harm the ozone layer, but these refrigerants all have a high global warming potential (GWP) and are considered to have a significant influence on global warming.

Further, such a turbo chiller is installed in a machine room of a building in many cases. If refrigerant leakage should occur due to an accident or the like, the refrigerant, which is heavier than air, pools in a lower portion. Unfortunately, the refrigerant leakage can be detected only at the time at which the refrigerant has leaked up to a concentration at which the refrigerant can be detected by a refrigerant detection sensor set in the machine room or at the time at which the chiller trips after discharge of the entire refrigerant. In both cases, a large amount of refrigerant leaks to be emitted into the atmosphere.

Meanwhile, in other air conditioners, chillers, heat pumps, and the like, a large number of refrigerant leakage detection sensors are set below a compressor, a condenser, an evaporator, and the like constituting a refrigeration cycle or to valves, joints, and the like provided to refrigerant pipes and connection portions of various components. When refrigerant leakage is detected by each refrigerant leakage detection sensor, an alarm is issued, and the occurrence site of the refrigerant leakage can be identified. PTLs 1 to 3 and the like present such an air conditioner or chiller or the refrigerant leakage detection sensor applied thereto.

CITATION LIST

Patent Literature

{PTL 1}
Japanese Unexamined Patent Application, Publication No. Hei 07-159010
{PTL 2}
Japanese Unexamined Patent Application, Publication No. 2009-198154
{PTL 3}
Japanese Unexamined Patent Application, Publication No. 2010-133601

SUMMARY OF INVENTION

Technical Problem

Unfortunately, according to PTLs 1 to 3, the large number of refrigerant leakage detection sensors need to be set below the compressor, the condenser, the evaporator, and the like that are devices constituting the air conditioner, the chiller, the heat pump, or the like or to the valves, the joints, and the like provided to the refrigerant pipes and the connection portions of the various components. This can enhance the detection accuracy of refrigerant leakage, but is not necessarily rational economically, because the large number of expensive refrigerant leakage detection sensors need to be set.

The present invention, which has been made in view of the above-mentioned circumstances, has an object to provide a turbo chiller that is economical and can early detect refrigerant leakage at its initial stage, to thereby prevent a large amount of refrigerant emission and reduce the amount of refrigerant at the time of refilling.

Solution to Problem

In order to solve the above-mentioned problem, a turbo chiller of the present invention adopts the following solutions.

The present invention provides a turbo chiller including: a turbo compressor; a motor for driving the turbo compressor; a refrigerant cooling pipe system and a lubricant pipe system connected to the turbo compressor and the motor; pipe joint groups provided to the pipe systems; and a joint group of replacement components provided to the pipe systems, the pipe joint groups and the joint group being intensively placed, the turbo chiller further including at least one refrigerant detection sensor that is arranged below the intensive placement region of the joint groups and at a pre-identified point at which a slight amount of refrigerant that leaks from each of the joint groups and flows downward is distributed and pools at a high concentration, the slight amount of refrigerant leakage being detectable by the refrigerant detection sensor.

The refrigerant normally used for the turbo chiller has a higher specific gravity than that of air, and hence the refrigerant that leaks from a pipe joint or the like flows vertically downward from its leakage site. Accordingly, assuming the occurrence of a slight amount of refrigerant leakage, for example, a leakage of about 5 $cm^3$/min due to deterioration or a trouble in packing, O-rings, and the like of the pipe joints and the joints of the replacement components such as strainers, filters, and pressure sensors provided in the pipes, the flow analysis is carried out, whereby a pooling point of the refrigerant having a concentration detectable by the refrigerant detection sensor can be clarified in advance on the basis of the concentration distribution of the refrigerant that continuously flows out downward.

According to the present invention, the pipe joint groups provided to the refrigerant cooling pipe system and the lubricant pipe system and the joint group of the replacement components provided to the pipe systems are intensively placed, and at least one refrigerant detection sensor is arranged below the intensive placement region of the joint groups and at the pre-identified point at which the slight amount of refrigerant that leaks from each of the joint groups and flows downward is distributed and pools at a high concentration. With this configuration, even if a slight amount (like so-called crab bubbles) of refrigerant leakage occurs from the pipe joint groups of the refrigerant cooling pipe system and the lubricant pipe system and from the joint group of the replacement components, the refrigerant leakage can be detected by the refrigerant detection sensor at the time at which the leaking refrigerant has flown downward to be distributed and pool at a concentration detectable by the refrigerant detection sensor at the pre-identified point at which the refrigerant detection sensor is arranged. Accordingly, the slight amount of refrigerant leakage can be detected by at least one refrigerant detection sensor at its initial stage. As a result, early discovery and early treatment of the refrigerant leakage can prevent a large amount of refrigerant emission, and can reduce the amount of refrigerant at the time of refilling. Further, the number of the set refrigerant detection sensors can be minimized, and hence simplified configuration and reduced costs can be achieved.

Moreover, in the turbo chiller of the present invention, the refrigerant cooling pipe system may at least include a refrigerant cooling pipe system that returns a refrigerant extracted from a downstream side of a condenser constituting a refrigeration cycle, to a lower-pressure side than that of the condenser through the motor and an oil cooler.

According to the present invention, the refrigerant cooling pipe system at least includes the refrigerant cooling pipe system that returns the refrigerant extracted from the downstream side of the condenser constituting the refrigeration cycle, to the lower-pressure side than that of the condenser through the motor and the oil cooler. With this configuration, in the case where a slight amount of refrigerant leakage occurs from the pipe joint group provided to the refrigerant cooling pipe system that circulates the refrigerant for cooling extracted from the downstream side of the condenser to the motor, the oil cooler, or the like and from the joint group of the replacement components such as the strainers and the filters, the refrigerant leakage can be detected by the refrigerant detection sensor at the time at which the leaking refrigerant has flown downward to be distributed and pool at a concentration detectable by the refrigerant detection sensor at the pre-identified point at which the refrigerant detection sensor is arranged. Accordingly, the slight amount of refrigerant leakage from the refrigerant cooling pipe system of the motor, the oil cooler, and the like can be detected at its initial stage, and early discovery and early treatment can prevent a large amount of refrigerant emission.

Moreover, in the turbo chiller of the present invention, the lubricant pipe system may at least include: a lubricant pipe system that circulates lubricant oil from an oil tank to the oil tank through an oil pump, the oil cooler, and the turbo compressor; and/or a lubricant pipe system that returns the lubricant oil from respective oil sumps of the turbo compressor and an evaporator to the oil tank.

According to the present invention, the lubricant pipe system at least includes: the lubricant pipe system that circulates the lubricant oil from the oil tank to the oil tank through the oil pump, the oil cooler, and the turbo compressor; and/or the lubricant pipe system that returns the lubricant oil from the respective oil sumps of the turbo compressor and the evaporator to the oil tank. With this configuration, in the case where a slight amount of leakage of the refrigerant dissolved in the lubricant oil occurs from the pipe joint group of the lubricant pipe system through which the lubricant oil is circulated and which is connected to the oil tank, the oil pump, the oil cooler, the turbo compressor, the evaporator, and the like and from the joint group of the replacement components such as the strainers and the filters, the refrigerant leakage can be detected by the refrigerant detection sensor at the time at which the leaking refrigerant has flown downward to be distributed and pool at a concentration detectable by the refrigerant detection sensor at the pre-identified point at which the refrigerant detection sensor is arranged. Accordingly, the slight amount of refrigerant leakage from the lubricant pipe system connected to the oil tank, the oil pump, the oil cooler, the turbo compressor, the evaporator, and the like can be detected at its initial stage, and early discovery and early treatment can prevent a large amount of refrigerant emission.

Moreover, in the turbo chiller of the present invention, the refrigerant cooling pipe system and the lubricant pipe system may be arranged in a spatial region that is located below the turbo compressor and the motor and between the evaporator and the condenser arranged parallel to each other, and the joint groups provided to the pipe systems may be intensively placed in the intensive placement region within the spatial region.

According to the present invention, the refrigerant cooling pipe system and the lubricant pipe system are arranged in the spatial region that is located below the turbo compressor and the motor and between the evaporator and the condenser arranged parallel to each other, and the joint groups provided to the pipe systems are intensively placed in the intensive placement region within the spatial region. With this configuration, in a typical layout of the turbo chiller including the evaporator and the condenser each configured as a shell-and-tube heat exchanger, the evaporator and the condenser are arranged parallel to each other, and the turbo compressor and the motor are placed thereabove. The refrigerant cooling pipe system and the lubricant pipe system are arranged using the spatial region located below the turbo compressor and the motor and between the evaporator and the condenser, and the plurality of joint groups provided to the pipe systems can be intensively placed in the intensive placement region within the spatial region. Accordingly, the slight amount of refrigerant that leaks from each of the joint groups and the like can be effectively guided, without spreading, to the refrigerant detection sensor arranged at the pre-identified point below the intensive placement region of the plurality of joint groups, so that the slight amount of refrigerant leakage can be reliably detected by one refrigerant detection sensor.

Moreover, in the turbo chiller of the present invention, the pipe systems and the replacement components may be arranged in a vertical direction in the intensive placement region, the joint groups of the pipe systems and the replacement components may be respectively arranged on the same vertical lines, and in a case where any of the pipe systems and the replacement components are arranged in a horizontal direction, the corresponding joint groups may be also respectively arranged on the same horizontal lines, gutters or trays may be respectively arranged below the joint groups, and the gutters or trays may guide the slight amount of refrigerant that leaks from each of the joint groups, to a position of the refrigerant detection sensor arranged at the pre-identified point.

According to the present invention, the pipe systems and the replacement components are arranged in the vertical direction in the intensive placement region, the joint groups of the pipe systems and the replacement components are respectively arranged on the same vertical lines, and in the case where any of the pipe systems and the replacement components are arranged in the horizontal direction, the corresponding joint groups are also respectively arranged on the same horizontal lines, the gutters or trays are respectively arranged below the joint groups, and the gutters or trays can guide the slight amount of refrigerant that leaks from each of the joint groups, to the position of the refrigerant detection sensor arranged at the pre-identified point. With this configuration, the refrigerant that leaks from each of the joint groups of the pipe systems and the replacement components that are arranged in the vertical direction can be caused to flow vertically downward along the pipe systems and the replacement components. Even if part of the pipe systems and the replacement components are arranged in the horizontal direction for some reason and if the corresponding joint groups are arranged slightly away therefrom in the horizontal direction, the gutters or trays provided therebelow can guide the leaking refrigerant to the set position of the refrigerant detection sensor. Accordingly, even if refrigerant leakage occurs from the joint groups located at positions slightly away in the horizontal direction, the refrigerant can be guided to the set position of the refrigerant detection sensor, so that the slight amount of refrigerant leakage can be reliably detected by one refrigerant detection sensor.

Moreover, in the above-mentioned configurations, at least one of the trays may have a size large enough to cover an area below: the turbo compressor and the motor; part of the pipe joint groups provided to the pipe systems connected to the turbo compressor and the motor; and part of the joint group of the replacement components provided to the pipe systems, and the slight amount of refrigerant that leaks from each of the joint groups may be guided to the set position of the refrigerant detection sensor directly from the least one of the trays or through the gutters or trays respectively provided below the other joint groups.

According to the present invention, at least one of the trays has a size large enough to cover the area below: the turbo compressor and the motor; part of the pipe joint groups provided to the pipe systems connected to the turbo compressor and the motor; and part of the joint group of the replacement components provided to the pipe systems, and the slight amount of refrigerant that leaks from each of the joint groups can be guided to the set position of the refrigerant detection sensor directly from the least one of the trays or through the gutters or trays respectively provided below the other joint groups. With this configuration, for devices such as the turbo compressor and the motor, to which the plurality of refrigerant cooling pipe systems and lubricant pipe systems, the various replacement components, and the joint groups are attached, the tray having the size large enough to cover the area therebelow is arranged. In this way, at whichever position refrigerant leakage occurs, the leaking refrigerant can be collected by the tray to be guided to the set position of the refrigerant detection sensor directly or through the other gutters or trays. Accordingly, the detection accuracy of the slight amount of refrigerant leakage can be improved around the devices such as the turbo compressor and the motor that include the large number of attached pipe systems, replacement components, and pipe joint groups and thus have a higher risk of refrigerant leakage, and early discovery and early treatment can prevent a large amount of refrigerant emission.

Advantageous Effects of Invention

According to the present invention, even if a slight amount (like so-called crab bubbles) of refrigerant leakage occurs from the pipe joint groups of the refrigerant cooling pipe system and the lubricant pipe system and from the joint group of the various replacement components, the refrigerant leakage can be detected by the refrigerant detection sensor at the time at which the leaking refrigerant has flown downward to be distributed and pool at a concentration detectable by the refrigerant detection sensor at the pre-identified point at which the refrigerant detection sensor is arranged. Accordingly, the slight amount of refrigerant leakage can be detected by at least one refrigerant detection sensor at its initial stage. As a result, early discovery and early treatment of the refrigerant leakage can prevent a large amount of refrigerant emission, and can reduce the amount of refrigerant at the time of refilling. Further, the number of the set refrigerant detection sensors can be minimized, and hence simplified configuration and reduced costs can be achieved.

DESCRIPTION OF EMBODIMENTS

Hereinafter, embodiments of the present invention are described with reference to the drawings.

First Embodiment

Hereinafter, a first embodiment of the present invention is described with reference to FIG. 1 and FIG. 2.

Figure 1:
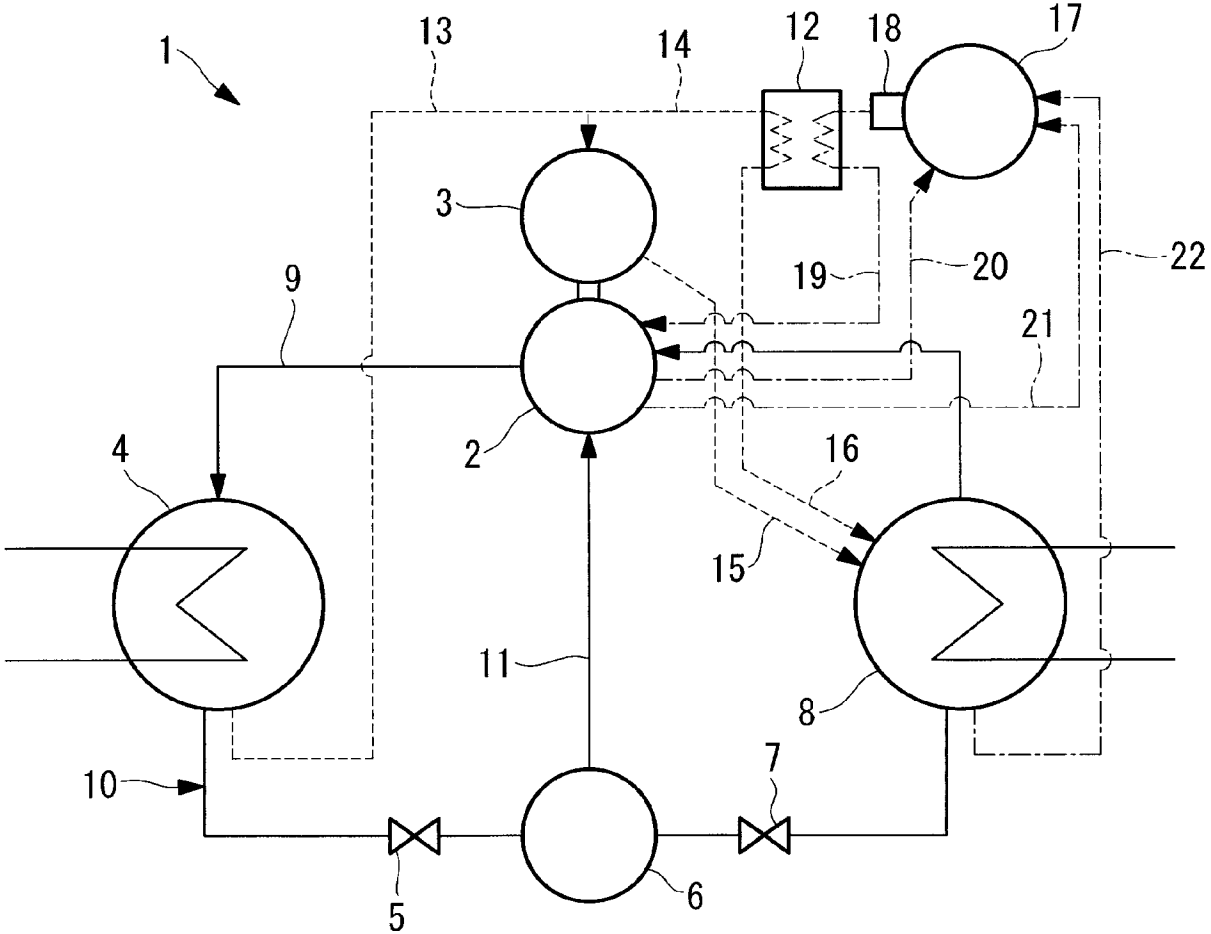
FIG. 1 is a refrigeration cycle diagram of a turbo chiller according to a first embodiment of the present invention.
Figure 2:
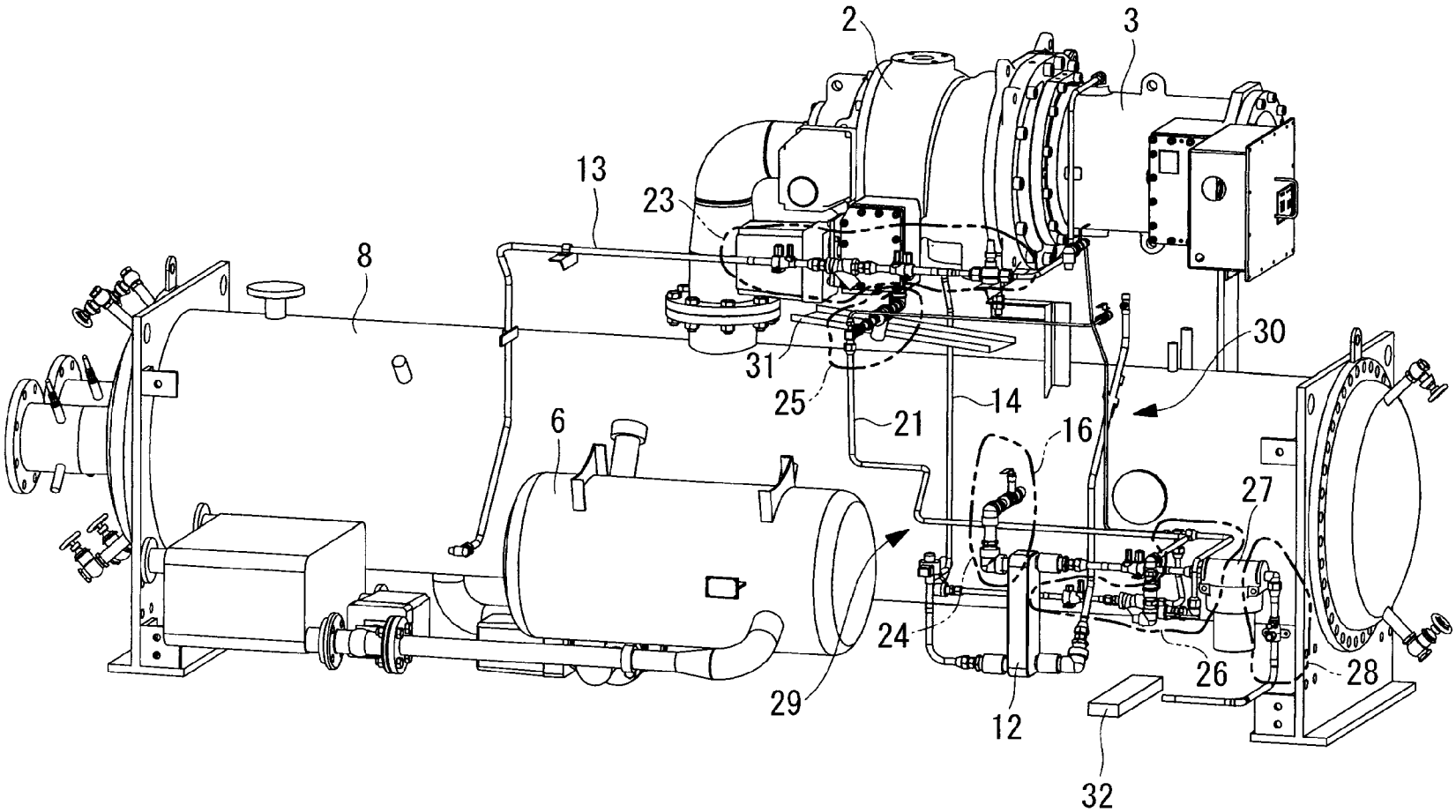
FIG. 2 is an external perspective view of the turbo chiller illustrated in FIG. 1, from which part of devices thereof are omitted.

FIG. 1 illustrates a refrigeration cycle of a turbo chiller 1 according to the present embodiment, and FIG. 2 illustrates an external perspective view of the turbo chiller 1, from which part of devices thereof are omitted.

The turbo chiller 1 includes a turbo compressor 2, an electric motor (may be simply referred to as "motor" in some cases) 3 that drives the turbo compressor 2, a condenser 4, a higher-stage expansion valve 5, an economizer 6, a lower-stage expansion valve 7, an evaporator 8, and the like. These devices are connected to each other by a refrigerant pipe 9, and thus constitute a closed refrigeration cycle 10.

The turbo compressor 2 and the electric motor 3 are configured as an electric compressor having a sealed structure in which housings of the turbo compressor 2 and the electric motor 3 are integrally coupled to each other. In the present embodiment, the turbo compressor 2 is a two-stage compressor, and the motor 3 is an inverter-driven electric motor. An output shaft of the motor 3 is coupled to a rotary shaft of the turbo compressor 2 through a speed increasing gear, whereby the turbo compressor 2 can be driven. The condenser 4 is configured as a shell-and-tube heat exchanger, and cooling water cooled by a cooling tower circulates in a large number of tubes, whereby high-pressure refrigerant gas from the turbo compressor 2 is cooled to be condensed and liquefied.

The economizer 6 is of a gas-liquid separation system or an intercooling system. In the case of the gas-liquid separation system, the refrigerant having a pressure reduced to an intermediate pressure by the higher-stage expansion valve 5 is separated into gas and liquid by a gas-liquid separator, and the obtained gas refrigerant is injected into intermediate-pressure gas between the first stage and the second stage of the two-stage turbo compressor 2 through an injection circuit 11. On the other hand, in the case of the intercooling system, an intercooler performs heat exchange between the refrigerant that flows through a main circuit and the refrigerant that flows through a branched circuit and has a pressure reduced to an intermediate pressure, and the branched-circuit-side gas refrigerant thus evaporated is injected into the intermediate-pressure gas between the first stage and the second stage of the two-stage turbo compressor 2 through the injection circuit 11. In this way, a known economizer circuit is configured.

The evaporator 8 is configured as a shell-and-tube heat exchanger, performs heat exchange between chilled water that returns from a load side and the low-pressure refrigerant having a pressure reduced by the lower-stage expansion valve 7, and cools the chilled water to a predetermined temperature to send out the chilled water to the load side. The turbo compressor 2 suctions the low-pressure refrigerant gas evaporated by the evaporator 8, compresses the suctioned refrigerant gas into high-pressure refrigerant gas again at the two stages, and discharges the high-pressure refrigerant gas to the condenser 4. The turbo chiller 1 repeats this cycle, to thereby produce chilled water by means of the evaporator 8.

In the turbo chiller 1 described above, refrigerant cooling pipe systems 13, 14, 15, and 16 are connected to the condenser 4, the electric motor 3, an oil cooler 12, and the evaporator 8 as indicated by broken lines in FIG. 1. The refrigerant cooling pipe systems 13 and 14 introduce part of the refrigerant condensed by the condenser 4 into the electric motor 3 and the oil cooler 12 through decompression means (not illustrated), so that the introduced refrigerant is evaporated to cool the electric motor 3 and lubricant oil. After that, the refrigerant cooling pipe systems 15 and 16 introduce the evaporated low-pressure refrigerant gas into the evaporator 8, to thereby return the refrigerant gas to the refrigeration cycle 10.

Further, the lubricant oil cooled by the oil cooler 12 can be circulated between the turbo compressor 2 and an oil tank 17 through an oil pump 18 and lubricant pipe systems 19 and 20. Parts to be lubricated such as bearings of the rotary shaft of the turbo compressor 2 are forcedly lubricated by the lubricant oil circulated by the oil pump 18. Moreover, lubricant pipe systems 21 and 22 are respectively provided between an oil sump of the housing of the turbo compressor 2 and the oil tank 17 and between an oil sump of the evaporator 8 and the oil tank 17, and the lubricant pipe systems 21 and 22 serve to return the lubricant oil that pools in each oil sump, to the oil tank 17.

As illustrated in FIG. 2, the refrigerant cooling pipe systems 13 to 16 and the lubricant pipe systems 19 to 22, as well as a pipe joint group 23 provided to the refrigerant cooling pipe system 13; a pipe joint group 24 provided to the refrigerant cooling pipe system 16; a pipe joint group 25 provided to the lubricant pipe system 21; a pipe joint group 26 provided to the lubricant pipe system 22; filters (replacement components) 27 provided to the lubricant pipe system 19; and a joint group 28 of the replacement components 27, are arranged using a spatial region 29. The spatial region 29 is located below the turbo compressor 2 and the electric motor 3 set above the condenser 4 and the evaporator 8 arranged parallel to each other (the condenser 4 arranged on the near side of the evaporator 8 is not illustrated in FIG. 2), and is located between the condenser 4 and the evaporator 8. In particular, the joint groups 23 to 28 are gathered and intensively placed in an intensive placement region 30 on a one-end side in the longitudinal direction of the spatial region 29.

The refrigerant cooling pipe systems 13 to 16 and the lubricant pipe systems 19 to 22, as well as the pipe joint groups 23, 24, 25, and 26 and the joint group 28 of the replacement components 27, are arranged in the vertical direction as far as possible. In the case where such vertical arrangement is not possible for some reason, the pipe systems are arranged in the horizontal direction, the pipe joint groups thereof and the joint group of the replacement components are also respectively arranged on the same horizontal lines, and a gutter 31 is arranged below the joint groups as needed, thus achieving effects equivalent to those of the case where the joint groups 23 to 28 are intensively placed in the intensive placement region 30 in which spreading in the horizontal direction is reduced as far as possible.

In general, the refrigerant used in the turbo chiller 1 is R134a, R245fa, and the like, and has a higher specific gravity than that of air. Accordingly, in the case where a slight amount of refrigerant leakage occurs due to deterioration or a trouble in packing, O-rings, and the like of the pipe joints provided to the refrigerant cooling pipe systems 13 to 16 and the lubricant pipe systems 19 to 22 and the joints of the replacement components such as strainers, filters, and pressure sensors provided in the pipes, the leaking refrigerant flows vertically downward from its leakage site. Accordingly, assuming the occurrence of a slight amount of refrigerant leakage, for example, a leakage of about 5 $cm^3$/min, the flow analysis is carried out, whereby a pooling point of the refrigerant having a concentration detectable by a refrigerant detection sensor can be clarified in advance on the basis of the concentration distribution of the refrigerant that continuously flows out downward.

In the present embodiment, the pipe joint groups 23 to 26 provided to the refrigerant cooling pipe systems 13 to 16 and the lubricant pipe systems 19 to 22 connected to the turbo compressor 2 and the motor 3 that drives the turbo compressor 2, as well as the joint group 28 of the various replacement components 27 provided to these pipe systems, are intensively placed in the intensive placement region 30 as described above. Then, one refrigerant detection sensor 32 is arranged below the intensive placement region 30 of the joint groups 23 to 28, and is arranged at the pre-identified portion at which a slight amount of refrigerant that leaks from each of the joint groups 23 to 28 and flows downward is distributed and pools at a high concentration, that is, at the point identified by the flow analysis described above. As a result, the slight amount of refrigerant leakage can be detected at its early stage by the smallest number of refrigerant detection sensors 32.

The present embodiment having the configuration as described above produces the following operations and effects.

For cooling and lubrication, the refrigerant cooling pipe systems 13 to 16 and the lubricant pipe systems 19 to 22 are connected to the turbo compressor 2 and the electric motor 3 having the sealed structure in which the housings of the turbo compressor 2 and the electric motor 3 are integrally coupled to each other. The lubricant oil and the refrigerant for cooling are circulated to the turbo compressor 2 and the electric motor 3 through these pipe systems, and the lubricant oil and the refrigerant thus serve to cool and lubricate the bearings and the like that support the rotary shaft of the turbo compressor 2 and to cool a stator, a rotor, and the like of the motor 3.

As illustrated in FIG. 2, the large number of pipe joint groups 23 to 26 and the joint group 28 of the various replacement components 27 such as the filters, the strainers, and the pressure sensors are provided to the refrigerant cooling pipe systems 13 to 16 and the lubricant pipe systems 19 to 22. Refrigerant leakage from the pipe systems and the joint groups may occur due to deterioration or a trouble in the packing, the O-rings, and the like used for the joint groups 23 to 28 and the like or due to contact of another article with the pipe systems and the joint groups. Such a leaking refrigerant has a higher specific gravity than that of air, and thus flows downward from its leakage site.

Under the circumstances, in the present embodiment, the pipe joint groups 23 to 26 provided to the refrigerant cooling pipe systems 13 to 16 and the lubricant pipe systems 19 to 22, as well as the joint group 28 of the various replacement components 27 provided to these pipe systems, are intensively placed in the intensive placement region 30 on the one-end side of the spatial region 29 located below the turbo compressor 2 and the motor 3 and between the condenser 4 and the evaporator 8. Then, the refrigerant detection sensor 32 that detects leaking refrigerant is arranged below the intensive placement region 30 of the joint groups 23 to 28, and is arranged at the point that is identified in advance by the flow analysis and at which the slight amount of refrigerant that leaks from each of the joint groups 23 to 28 and flows downward is distributed and pools at a high concentration.

Accordingly, even if a slight amount (like so-called crab bubbles) of refrigerant leakage occurs from the pipe joint groups 23 to 26 of the refrigerant cooling pipe systems 13 to 16 and the lubricant pipe systems 19 to 22 and from the joint group 28 of the replacement components 27, the refrigerant leakage can be detected by the refrigerant detection sensor 32 at the time at which the leaking refrigerant has flown downward from its leakage site to be distributed and pool at a concentration detectable by the refrigerant detection sensor 32 at the pre-identified point at which the refrigerant detection sensor 32 is arranged.

Accordingly, for example, even a slight amount of refrigerant leakage of about 5 $cm^3$/min can be detected by one refrigerant detection sensor 32 at its initial stage. As a result, early discovery and early treatment of the refrigerant leakage can prevent a large amount of refrigerant emission from the turbo chiller 1, and can reduce the amount of refrigerant at the time of refilling. Further, the number of the set refrigerant detection sensors 32 can be minimized, and hence simplified configuration and reduced costs can be achieved.

Further, the refrigerant cooling pipe systems 13 to 16 at least includes refrigerant cooling pipe systems 13 to 16 that return the refrigerant extracted from the downstream side of the condenser 4 constituting the refrigeration cycle 10, to the lower-pressure side than that of the condenser 4 of the refrigeration cycle 10 through the motor 3, the oil cooler 12, and the like. In the case where a slight amount of refrigerant leakage occurs from the pipe joint groups 23 and 24 provided to the refrigerant cooling pipe systems 13 to 16 that circulate the refrigerant for cooling extracted from the downstream side of the condenser 4 to the motor 3, the oil cooler 12, and the like and from the joints of the replacement components such as the strainers and the filters (not illustrated), the refrigerant leakage can be detected by the refrigerant detection sensor 32 at the time at which the leaking refrigerant has flown downward to be distributed and pool at a concentration detectable by the refrigerant detection sensor 32 at the pre-identified point at which the refrigerant detection sensor 32 is arranged. Accordingly, the slight amount of refrigerant leakage from the refrigerant cooling pipe systems 13 to 16 of the motor 3, the oil cooler 12, and the like can be detected at its initial stage, and early discovery and early treatment can prevent a large amount of refrigerant emission.

Moreover, the lubricant pipe systems 19 to 22 at least includes: lubricant pipe systems 19 and 20 that circulate the lubricant oil from the oil tank 17 to the oil tank 17 through the oil pump 18, the oil cooler 12, the turbo compressor 2, and the like; and/or lubricant pipe systems 21 and 22 that returns the lubricant oil from the respective oil sumps of the turbo compressor 2, the evaporator 8, and the like to the oil tank 17. In the case where a slight amount of leakage of the refrigerant dissolved in the lubricant oil occurs from the pipe joint groups 25 and 26 of the lubricant pipe systems 19 to 22 through which the lubricant oil is circulated and which are connected to the oil tank 17, the oil pump 18, the oil cooler 12, the turbo compressor 2, the evaporator 8, and the like and from the joint group 28 of the replacement components 27 such as the strainers and the filters, the refrigerant leakage can be detected by the refrigerant detection sensor 32 at the time at which the leaking refrigerant has flown downward to be distributed and pool at a concentration detectable by the refrigerant detection sensor 32 at the pre-identified point at which the refrigerant detection sensor 32 is arranged. Accordingly, the slight amount of refrigerant leakage from the lubricant pipe systems 19 to 22 connected to the oil tank 17, the oil pump 18, the oil cooler 12, the turbo compressor 2, the evaporator 8, and the like can be detected at its initial stage, and early discovery and early treatment can prevent a large amount of refrigerant emission.

Further, the refrigerant cooling pipe systems 13 to 16 and the lubricant pipe systems 19 to 22 are arranged in the spatial region 29 located below the turbo compressor 2 and the motor 3 integrated with each other and between the evaporator 8 and the condenser 4 arranged parallel to each other, and the joint groups 23 to 28 provided to the pipe systems 13 to 16 and 19 to 22 are intensively placed in the intensive placement region 30 within the spatial region 29.

In this way, in a typical layout of the turbo chiller 1 including the evaporator 8 and the condenser 4 each configured as a shell-and-tube heat exchanger, the evaporator 8 and the condenser 4 are arranged parallel to each other, and the turbo compressor 2 and the motor 3 integrated with each other are placed thereabove. The refrigerant cooling pipe systems 13 to 16 and the lubricant pipe systems 19 to 22 are arranged using the spatial region 29 located below the turbo compressor 2 and the motor 3 and between the evaporator 8 and the condenser 4, and the plurality of joint groups 23 to 28 provided to these pipe systems can be intensively placed in the intensive placement region 30 within the spatial region 29. Accordingly, a slight amount of refrigerant that leaks from each of the joint groups 23 to 28 and the like can be effectively guided, without spreading, to the refrigerant detection sensor 32 arranged at the pre-identified point below the intensive placement region 30 of the plurality of joint groups 23 to 28, so that the slight amount of refrigerant leakage can be reliably detected by one refrigerant detection sensor 32.

Moreover, in the present embodiment, the pipe systems 13 to 16 and 19 to 22 and the replacement components 27 are arranged in the vertical direction in the intensive placement region 30, and the joint groups 23 to 28 thereof are respectively arranged on the same vertical lines. In the case where any of the pipe systems 13 to 16 and 19 to 22 and the replacement components 27 are arranged in the horizontal direction, the corresponding joint groups 23 to 28 are also respectively arranged on the same horizontal lines. The gutter 31 or a tray is arranged below the joint group 23 as needed, and the gutter 31 or the tray can guide a slight amount of refrigerant that leaks from each of the joint groups 23 to 28, to the position of the refrigerant detection sensor 32 arranged at the identified point.

As a result, the refrigerant that leaks from each of the joint groups 23 to 28 of the pipe systems 13 to 16 and 19 to 22 and the replacement components 27 that are arranged in the vertical direction can be caused to flow vertically downward along the pipe systems 13 to 16 and 19 to 22 and the replacement components 27. Even if part of the pipe systems 13 to 16 and 19 to 22 and the replacement components 27 are arranged in the horizontal direction for some reason and if the corresponding joint groups 23 to 28 are arranged slightly away therefrom in the horizontal direction, the gutter 31 or the tray provided therebelow can guide the leaking refrigerant to the set position of the refrigerant detection sensor 32. Accordingly, even if refrigerant leakage occurs from the joint groups 23 to 28 at positions slightly away in the horizontal direction, the refrigerant can be guided to the set position of the refrigerant detection sensor 32, so that the slight amount of refrigerant leakage can be reliably detected by one refrigerant detection sensor 32.

Second Embodiment

Figure 4:
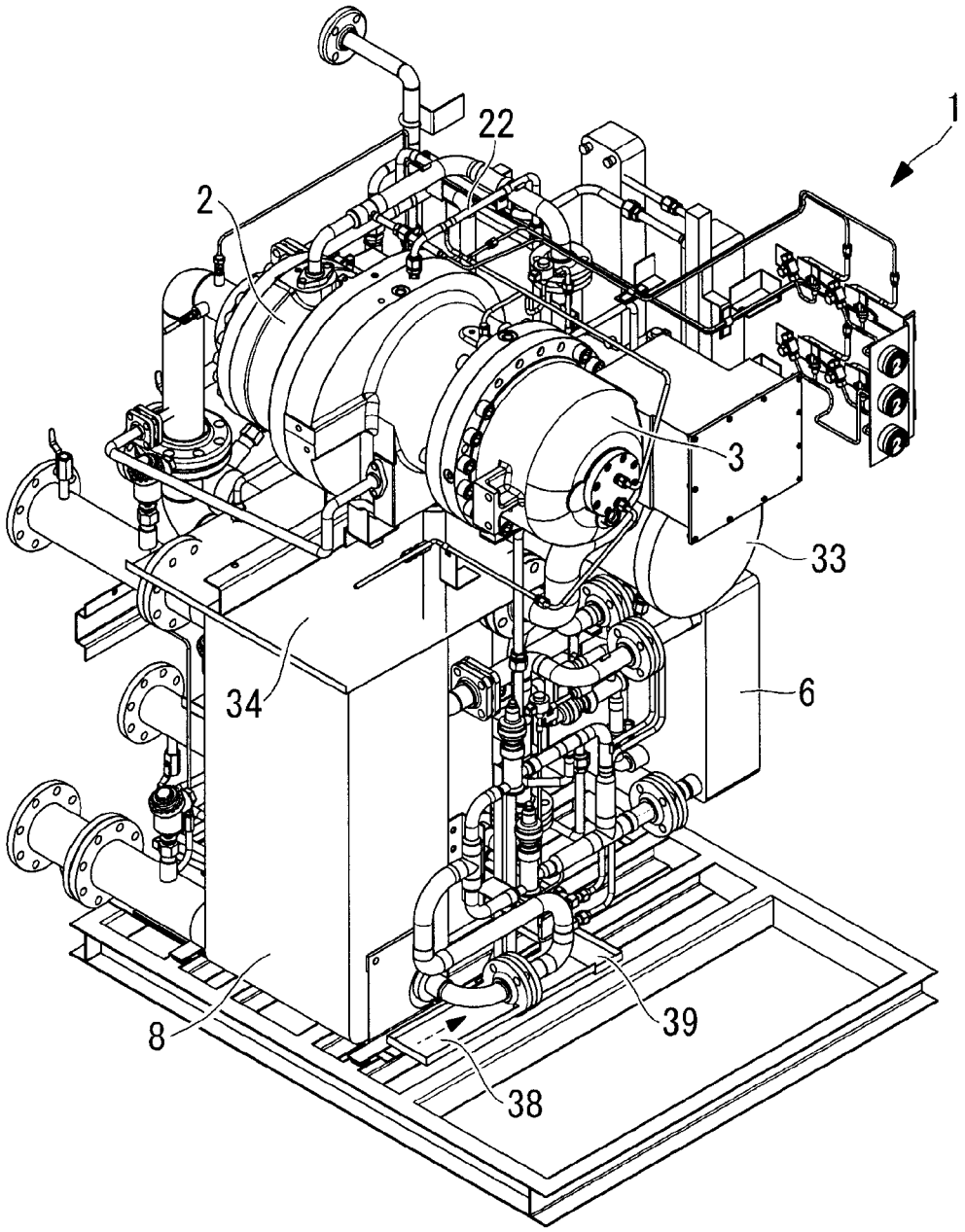
FIG. 4 is an external perspective view of a back side of the turbo chiller illustrated in FIG. 3, which is observed from its upper right.
Figure 5:
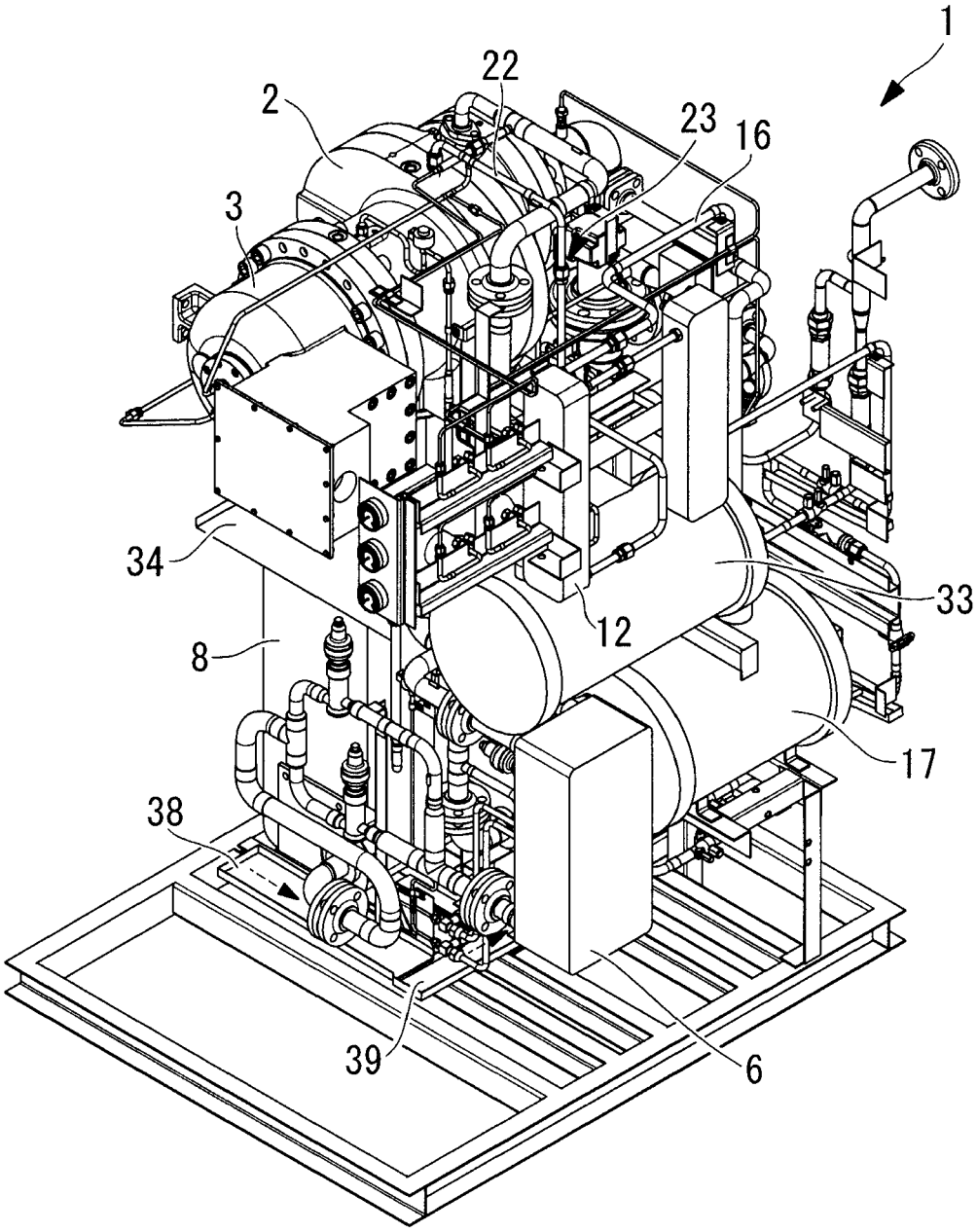
FIG. 5 is an external perspective view of a left side of the turbo chiller illustrated in FIG. 3, which is observed from its upper right.

Next, a second embodiment of the present invention is described with reference to FIG. 3 to FIG. 5.

The present embodiment relates to a turbo heat pump example. The present embodiment is different from the first embodiment described above in that: the condenser 4 and the evaporator 8 are each configured as a rectangular plate heat exchanger; the economizer 6, the oil tank 17, an oil separator 33, and the like are placed around the condenser 4 and the evaporator 8; and the turbo compressor 2 and the motor 3 having the integrated and sealed structure, the oil cooler 12, and the like are placed above the condenser 4 and the evaporator 8. The present embodiment is the same as the first embodiment in the configuration of the refrigeration cycle 10 and the basic configuration including the refrigerant cooling pipe systems 13 to 16 and the lubricant pipe systems 19 to 22, and hence different points are mainly described below.

Similarly to the first embodiment, the refrigerant cooling pipe systems 13 to 16 and the lubricant pipe systems 19 to 22 are connected to the turbo compressor 2 and the motor 3 that are placed above the condenser 4 and the evaporator 8 and are integrated with each other. A wide tray 34 is placed obliquely in a predetermined direction so as to cover an area below: the turbo compressor 2 and the motor 3; part of the refrigerant cooling pipe systems 13 to 16 and the lubricant pipe systems 19 to 22 connected to the turbo compressor 2 and the motor 3; and part of the pipe joint groups 23 to 26 and the joint group 28 of the various replacement components 27 provided to these pipe systems.

Figure 3:
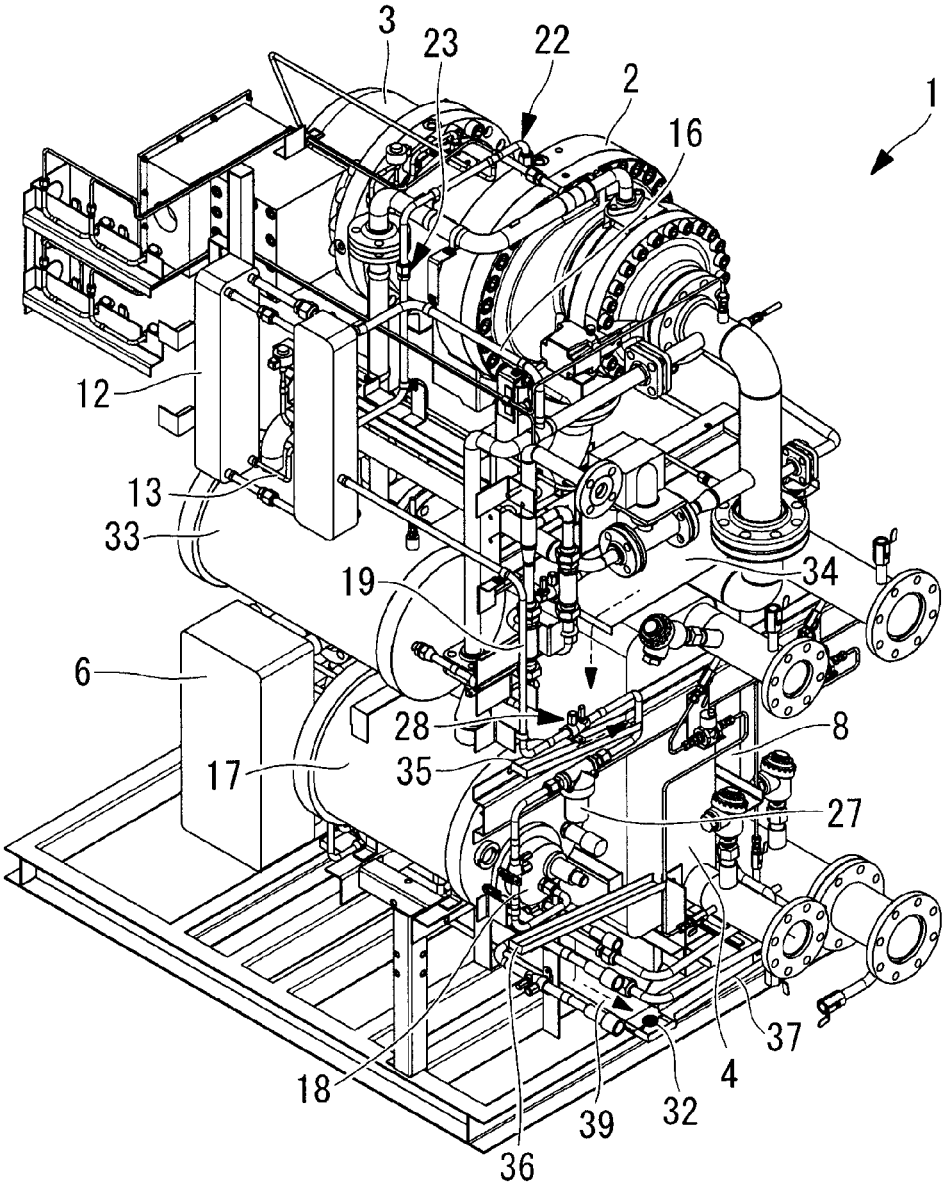
FIG. 3 is an external perspective view of a turbo chiller according to a second embodiment of the present invention.

In the case where the refrigerant leaks from the devices, the joint groups of the pipe systems, and the like arranged above the tray 34, the tray 34 serves to receive the refrigerant that flows downward from its leakage site, guide the refrigerant along the predetermined oblique direction as indicated by a broken line in FIG. 3, and bring the refrigerant further downward. Further, the pipe joint groups provided to the refrigerant cooling pipe systems 13 to 16, the lubricant pipe systems 19 to 22, or other pipe systems are gathered to one side below the set position of the tray 34, and gutter-like trays 35, 36, 37, and 38 are arranged below these gathered pipe joint groups as needed. The refrigerants that have been respectively guided by the tray 34, the trays 35, 36, 37, and 38, and the like to flow downward are caused to join together on a tray 39 that is arranged over the entire width in the width direction at the lowermost position.

Note that examples of the other pipe systems described above include a pipe system connected to the economizer 6, and the tray 38 is arranged below a pipe joint group provided to this pipe system. A confluence point of the refrigerants that have flown downward directly or through the trays 34 to 38 from above as indicated by broken lines in FIG. 3 and FIG. 5 is set in advance to the tray 39, and the refrigerant detection sensor 32 is arranged correspondingly to the set confluence point. Accordingly, the refrigerant leakage becomes detectable when the concentration of the refrigerant at the confluence point reaches a concentration detectable by the refrigerant detection sensor 32.

Accordingly, similarly to the first embodiment, also in the present embodiment, a slight amount of refrigerant leakage can be detected at its initial stage by the smallest number of refrigerant detection sensors 32. As a result, early discovery and early treatment of the refrigerant leakage can prevent a large amount of refrigerant emission from the turbo chiller 1, and can reduce the amount of refrigerant at the time of refilling. Further, the number of the set refrigerant detection sensors 32 can be minimized, and hence effects such as simplified configuration and reduced costs can be achieved.

Particularly in the present embodiment, the tray 34 has the size large enough to cover an area below: the turbo compressor 2 and the motor 3; part of the pipe joint groups 23 to 26 provided to the pipe systems 13 to 16 and 19 to 22 connected to the turbo compressor 2 and the motor 3; and part of the joint group 28 of the replacement components 27 provided to these pipe systems. Then, a slight amount of refrigerant that leaks from each of the joint groups 23 to 28 and the like can be guided to the set position of the refrigerant detection sensor 32 directly from the tray 34 or through the gutters or trays 35 to 39 respectively provided below the other joint groups. Accordingly, for devices such as the turbo compressor 2 and the motor 3, to which the plurality of refrigerant cooling pipe systems 13 to 16 and lubricant pipe systems 19 to 22, the various replacement components 27, and the joint groups 23 to 28 are attached, the tray 34 having the size large enough to cover the area therebelow is arranged. In this way, at whichever position refrigerant leakage occurs, the leaking refrigerant can be collected by the tray 34 to be guided to the set position of the refrigerant detection sensor 32 directly or through the other gutters or trays 35 to 39.

Accordingly, the detection accuracy of a slight amount of refrigerant leakage can be improved around the devices such as the turbo compressor 2 and the motor 3 that include the large number of attached pipe systems 13 to 16 and 19 to 22, replacement components 27, and joint groups 23 to 28 and thus have a higher risk of refrigerant leakage, and early discovery and early treatment can prevent a large amount of refrigerant emission.

Note that the present invention is not limited to the above-mentioned embodiments, and can be modified as appropriate within a range not departing from the gist thereof. For example, in the above-mentioned embodiments, refrigerant leakage from the pipe joint groups provided to the refrigerant cooling pipe systems 13 to 16 and the lubricant pipe systems 19 to 22 and the joint group of the replacement components is detected, but if the main refrigeration cycle 10 includes a pipe system connected through a pipe joint group, refrigerant leakage from the pipe joint group of the pipe system may be similarly detected.

REFERENCE SIGNS LIST

1 turbo chiller
2 turbo compressor
3 electric motor (motor)
4 condenser
8 evaporator
10 refrigeration cycle
12 oil cooler
13, 14, 15, 16 refrigerant cooling pipe system
17 oil tank
18 oil pump
19, 20, 21, 22 lubricant pipe system
23, 24, 25, 26 pipe joint group
27 replacement component
28 joint group of replacement component
29 spatial region
30 intensive placement region
31 gutter
32 refrigerant detection sensor
34, 35, 36, 37, 38, 39 tray

The invention claimed is:

1. A turbo chiller comprising:
a turbo compressor;
a motor for driving the turbo compressor;
a refrigerant cooling pipe system and a lubricant pipe system connected to the turbo compressor and the motor;
pipe joint groups provided to the pipe systems;

a joint group of replacement components provided to the pipe systems;

an evaporator; and a condenser, wherein the evaporator and the condenser are arranged horizontally and in parallel to each other, wherein a spatial region is provided between the evaporator and the condenser, wherein an intensive placement region in which the pipe joint groups and the joint group are intensively placed in a part of the spatial region, wherein at least one refrigerant detection sensor is arranged at a specified point at which refrigerant that leaks from each of the joint groups and flows downward is distributed and pools below the intensive placement region, wherein the pipe systems and the replacement components are arranged in a vertical direction in the intensive placement region, the joint groups of the pipe systems and the replacement components are respectively arranged on the same vertical lines, and in a case where any of the pipe systems and the replacement components are arranged in a horizontal direction, the corresponding joint groups are also respectively arranged on the same horizontal lines, gutters or trays are respectively arranged below the joint groups, and the gutters or trays guide the slight amount of refrigerant that leaks from each of the joint groups, to a position of the refrigerant detection sensor arranged at the pre-identified point.

2. The turbo chiller according to claim 1, wherein a plurality of the refrigerant cooling pipe systems are provided, said plurality of the refrigerant cooling pipe system at least includes a first refrigerant cooling pipe system that returns a refrigerant extracted from a downstream side of a condenser constituting a refrigeration cycle, to a lower-pressure side than that of the condenser through the motor and an oil cooler.

3. The turbo chiller according to claim 1, wherein a plurality of the lubricant pipe systems are provided, said plurality of the lubricant pipe systems at least include: a first lubricant pipe system that connects an oil tank, an oil pump, an oil cooler, and the turbo compressor and that circulates lubricant oil from the oil tank through the oil pump, the oil cooler, and the turbo compressor to the oil tank; and/or a second lubricant pipe system that connects an oil sump of the turbo compressor, an oil sump of an evaporator, and the oil tank and that returns the lubricant oil from the turbo compressor to the oil tank.

4. The turbo chiller according to claim 1, wherein the refrigerant cooling pipe system and the lubricant pipe system are arranged in the spatial region that is located below the turbo compressor and the motor.

5. A turbo chiller comprising:

a turbo compressor;

a motor for driving the turbo compressor;

a refrigerant cooling pipe system and a lubricant pipe system connected to the turbo compressor and the motor;

pipe joint groups provided to the pipe systems;

a joint group of replacement components provided to the pipe systems;

an evaporator; and a condenser, wherein, in a case where the pipe systems and the replacement components are arranged in a vertical direction, the corresponding joint groups are respectively arranged on the same vertical lines, wherein, in a case where any of the pipe systems and the replacement components are arranged in a horizontal direction, the corresponding joint groups are respectively arranged on the same horizontal lines, wherein at least one refrigerant detection sensor is arranged at a specified point at which refrigerant that leaks from each of the joint groups and flows downward is distributed and pools below an area where the pipe systems, the replacement components, and the corresponding joint groups are arranged, wherein a plurality of trays are arranged below the joint groups, wherein a first tray in which at least one of said plurality of the trays has a size large enough to cover an area below: the turbo compressor and the motor; part of the pipe joint groups provided to the pipe systems connected to the turbo compressor and the motor; and part of the joint group of the replacement components provided to the pipe systems, wherein the first tray is arranged between the turbo compressor and the motor; part of the pipe joint groups provided to the pipe systems connected to the turbo compressor and the motor; and part of the joint group of the replacement components provided to the pipe systems, and, the evaporator; the condenser, wherein, in a case where the refrigerant leaks from at least one of the turbo compressor and the motor; the pipe joint groups; and the joint group of the replacement components, the first tray serves to receive the refrigerant that flows downward from a leakage site and to guide the refrigerant along an oblique direction, wherein a second tray which is another tray of said plurality of the trays brings the refrigerant which is guided from the first tray further downward, and wherein a third tray which is further another tray of said plurality of the trays guides the refrigerant which is brought from the second tray to the position of the refrigerant detection sensor.

6. The turbo chiller according to claim 1, wherein the intensive placement region is provided on a one-end side in the longitudinal direction of the spatial region.

7. The turbo chiller according to claim 1, wherein, the occurrence of refrigerant leakage from the joint groups is assumed and a flow analysis is carried out, whereby a pooling point of the refrigerant having a concentration detectable by the refrigerant detection sensor can be clarified in advance on the basis of a concentration distribution of the refrigerant that continuously flows out downward, and wherein the pooling point is determined as the specified point.

8. A turbo chiller comprising:

a turbo compressor;

a motor for driving the turbo compressor;

a refrigerant cooling pipe system and a lubricant pipe system connected to the turbo compressor and the motor;

pipe joint groups provided to the pipe systems;

a joint group of replacement components provided to the pipe systems;

an evaporator; and a condenser, wherein the evaporator and the condenser are arranged horizontally and in parallel to each other, wherein a spatial region is provided between the evaporator and the condenser, wherein an intensive placement region in which the pipe joint groups and the joint group are intensively placed in a part of the spatial region, wherein at least one refrigerant detection sensor is arranged at a specified point at which refrigerant that leaks from each of the joint groups and flows downward is distributed and pools below the intensive placement region, wherein, the occurrence of refrigerant leakage from the joint groups is assumed and a flow analysis is carried out, whereby a pooling point of the refrigerant having a concentration detectable by the refrigerant detection sensor can be clarified in advance on the basis of a concentration distribution of the refrigerant that continuously flows out downward, and wherein the pooling point is determined as the specified point.

9. The turbo chiller according to claim 8, wherein a plurality of the refrigerant cooling pipe systems are provided, said plurality of the refrigerant cooling pipe systems at least include a first refrigerant cooling pipe system that returns a refrigerant extracted from a downstream side of a condenser constituting a refrigeration cycle, to a lower-pressure side than that of the condenser through the motor and an oil cooler.

10. The turbo chiller according to claim 8, wherein a plurality of the lubricant pipe systems are provided, said plurality of the lubricant pipe systems at least include: a first lubricant pipe system that connects an oil tank, an oil pump, an oil cooler, and the turbo compressor and that circulates lubricant oil from the oil tank through the oil pump, the oil cooler, and the turbo compressor to the oil tank; and/or a second lubricant pipe system that connects an oil sump of the turbo compressor, an oil sump of an evaporator, and the oil tank and that returns the lubricant oil from the turbo compressor to the oil tank.

11. The turbo chiller according to claim 8, wherein the refrigerant cooling pipe system and the lubricant pipe system are arranged in the spatial region that is located below the turbo compressor and the motor.

12. The turbo chiller according to claim 8, wherein the intensive placement region is provided on a one-end side in the longitudinal direction of the spatial region.

* * * * *